US007737801B2

(12) United States Patent
Kishimoto

(10) Patent No.: US 7,737,801 B2
(45) **Date of Patent: *Jun. 15, 2010**

(54) NON-RECIPROCAL CIRCUIT DEVICE

(75) Inventor: Yasushi Kishimoto, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/097,190

(22) PCT Filed: Dec. 18, 2006

(86) PCT No.: PCT/JP2006/325206

§ 371 (c)(1),
(2), (4) Date: Jun. 12, 2008

(87) PCT Pub. No.: WO2007/069768

PCT Pub. Date: Jun. 21, 2007

(65) Prior Publication Data

US 2009/0167454 A1 Jul. 2, 2009

(30) Foreign Application Priority Data

Dec. 16, 2005 (JP) ..... 2005-363495

(51) Int. Cl.
*H01P 1/365* (2006.01)
*H01P 1/36* (2006.01)

(52) U.S. Cl. ..... 333/24.2

(58) Field of Classification Search ..... 333/1.1, 333/24.2

See application file for complete search history.

(56) References Cited

U.S. PATENT DOCUMENTS

| | | | |
|---|---|---|---|
| 2003/0011439 | A1 | 1/2003 | Kawanami |
| 2004/0004521 | A1 | 1/2004 | Hasegawa |
| 2005/0052256 | A1 | 3/2005 | Hasegawa et al. |

FOREIGN PATENT DOCUMENTS

| | | | |
|---|---|---|---|
| JP | 2003-087014 | A | 3/2003 |
| JP | 2004-088743 | A | 3/2004 |
| JP | 2004-088744 | A | 3/2004 |
| JP | 2005-102143 | A | 4/2005 |

*Primary Examiner*—Stephen E Jones
(74) *Attorney, Agent, or Firm*—Sughrue Mion, PLLC

(57) ABSTRACT

A non-reciprocal circuit device comprising a first inductance element disposed between a first input/output port and a second input/output port; a second inductance element disposed between the second input/output port and the ground; a first capacitance element constituting a first parallel resonance circuit with the first inductance element; a resistance element parallel-connected to the first parallel resonance circuit; a third inductance element series-connected between the second inductance element and the ground; and a second capacitance element constituting a second parallel resonance circuit with the second and third inductance elements.

8 Claims, 14 Drawing Sheets

NON-RECIPROCAL CIRCUIT DEVICE

This application is a National Stage of International Application No. PCT/JP2006/325206 filed on Dec. 18, 2006, claiming priority based on Japanese Patent Application No. 2005-363495, filed on Dec. 16, 2005 the contents of all of which are incorporated herein by reference in their entirety.

FIELD OF THE INVENTION

The present invention relates to a non-reciprocal circuit device having a characteristic of non-reciprocally transmitting high-frequency signals, particularly to a non-reciprocal circuit device generally called "isolator," which is used in mobile communications systems such as cell phones, etc.

BACKGROUND OF THE INVENTION

Non-reciprocal circuit devices such as isolators are used in mobile communications equipments utilizing frequencies from several hundreds MHz to ten-odds GHz, such as base stations and terminals of cell phones, etc. Isolators disposed between power amplifiers and antennas in mobile communications equipments are required to have excellent insertion loss characteristics, reflection loss characteristics and isolation characteristics to prevent unnecessary signals from returning to power amplifiers at the time of transmission, and to stabilize the impedance of power amplifiers on the load side.

As such a non-reciprocal circuit device, an isolator shown in FIG. 18 is conventionally well known. This isolator comprises three central conductors 21, 22, 23 crossing at an angle of 120° with electric insulation on one main surface of a ferrimagnetic microwave ferrite 30. Each central conductor 21, 22, 23 has one end connected to the ground and the other end connected to a matching capacitor C1-C3. A terminal resistor Rt is connected to a port (for instance, P3) of one of the central conductors 21, 22, 23. A DC magnetic field Hdc is applied from a permanent magnet (not shown) to the ferrite 30 axially. This isolator functions such that high-frequency signals input from a port P1 are transmitted to a port P2, while reflected waves entering a port 2 are prevented from being transmitted to a port P1 by absorption by the terminal resistor Rt, so that unnecessary reflected waves generated by the impedance variation of an antenna are prevented from entering a power amplifier, etc.

Recently much attention has been paid to an isolator constituted by a different equivalent circuit from those of conventional three-terminal isolators, which has excellent insertion loss characteristics and reflection characteristics. For instance, the isolator described in JP 2004-88743 A is called "two-terminal isolator," which has two central conductors. FIG. 19 shows the equivalent circuit of its basic structure. This two-terminal isolator comprises a first central conductor (first inductance element) L1 electrically connected between a first input/output port P1 and a second input/output port P2; a second central conductor (second inductance element) L2 crossing the first central conductor L1 with electric insulation and electrically connected between the second input/output port P2 and the ground; a first capacitance element C1 electrically connected between the first input/output port P1 and the second input/output port P2 to constitute a first parallel resonance circuit with the first central conductor L1; a resistance element R; and a second capacitance element C2 electrically connected between the second input/output port P2 and the ground to constitute a second parallel resonance circuit with the second central conductor L2.

The first parallel resonance circuit sets a frequency at which the isolation (reverse attenuation characteristics) is the maximum, and the second parallel resonance circuit sets a frequency at which the insertion loss is the minimum. When high-frequency signals are transmitted from the first input/output port P1 to the second input/output port P2, resonance does not occur in the first parallel resonance circuit between the first input/output port P1 and the second input/output port P2, but the second parallel resonance circuit is resonated, resulting in small transmission loss (excellent insertion loss characteristics). Current reversely flowing from the second input/output port P2 to the first input/output port P1 is absorbed by the resistance element R connected between the first input/output port P1 and the second input/output port P2.

FIG. 20 shows a specific example of the structure of a two-terminal isolator. This two-terminal isolator 1 comprises metal cases (upper case 4 and lower case 8) made of a ferromagnetic material such as soft iron to constitute a magnetic circuit, a permanent magnet 9, a central conductor assembly 30 comprising a microwave ferrite 20 and central conductors 21, 22, and a laminate substrate 50 on which the central conductor assembly 30 is mounted.

The upper yoke 4 for containing the permanent magnet 9 is substantially in a box shape having an upper surface 4*a* and four side surfaces 4*b*. The lower yoke 8 has a bottom surface 8*a* and a pair of side surfaces 8*b*. Each surface of the upper and lower yokes 4, 8 is properly plated with a conductive metal such as Ag, Cu, etc.

The central conductor assembly 30 comprises a disc-shaped microwave ferrite 20, and first and second central conductors 21, 22 perpendicularly crossing on an upper surface of the microwave ferrite 20 via an insulating layer (not shown), such that the first and second central conductors 21, 22 are electromagnetically coupled to each other at an intersection. Each of the first and second central conductors 21, 22 is constituted by two lines, and both end portions thereof are separated from each other and extend under the microwave ferrite 20.

FIG. 21 is an exploded view of the laminate substrate 50. The laminate substrate 50 is constituted by a dielectric sheet 41 having connecting electrodes 51-54 connected to ends of the central conductors 21 and provided with capacitor electrodes 55, 56 and a resistor 27 on the rear surface, a dielectric sheet 42 provided with a capacitor electrode 57 on the rear surface, a dielectric sheet 43 provided with a ground electrode 58 on the rear surface, a dielectric sheet 45 provided with an external input electrode 14, an external output electrode 14 and external ground electrodes 16, etc.

The central-conductor-connecting electrode 51 corresponds to the first input/output port P1 in the above equivalent circuit, and the central-conductor-connecting electrodes 53, 54 correspond to the second input/output port P2. One end of the first central conductor 21 is electrically connected to the external input electrode 14 via the first input/output port P1 (central-conductor-connecting electrode 51). The other end of the first central conductor 21 is electrically connected to the external output electrode 14 via the second input/output port P2 (central-conductor-connecting electrode 54). One end of the second central conductor 22 is electrically connected to the external output electrode 14 via the second input/output port P2 (central-conductor-connecting electrode 53). The other end of the second central conductor 22 is electrically connected to the external ground electrode 16. The first capacitance element C1 is electrically connected between the first input/output port P1 and the second input/output port P2 to constitute a first parallel resonance circuit with the first central conductor L1. The second capacitance element C2 is electrically connected between the second input/output port P2 and the ground to constitute a second parallel resonance circuit with the second central conductor L2.

To provide multi-functional, lightweight cell phones, the miniaturization of their parts is strongly demanded. As non-reciprocal circuit devices are demanded to be as small as about 2.5 mm×2.5 mm×1.0 mm, the microwave ferrite 20, for instance, is also demanded to be as small as having an overall size of about 1.0 mm×1.0 mm×0.15 mm. However, the miniaturization of the microwave ferrite 20 invites decrease in the inductance of inductors constituted by central conductors.

If the microwave ferrite 20 were made small like this, practically useful characteristics cannot be obtained in the three-terminal, non-reciprocal circuit device shown in FIG. 18. Although the two-terminal isolator described in JP 2004-88743 A, which is shown in FIG. 19, has better electric characteristics than those of the three-terminal non-reciprocal circuit device, its insertion loss exceeds 1 dB in the passband, unsatisfactory for practical applications.

To obtain a non-reciprocal circuit device having excellent electric characteristics, various factors generated in the products, such as parasitic inductance, floating capacitance, etc. should be taken into consideration. Even if the above two-terminal isolator were ideally designed, parasitic inductance, floating capacitance, etc. would occur in the first and second parallel resonance circuits for structural reasons in its operation, resulting in impedance deviated from the designed level. To avoid the deterioration of insertion loss characteristics and isolation characteristics due to impedance mismatching with other connected circuits, it is necessary to find optimum values through repeated test production, taking a long period of time for the development of products.

Because the first and second central conductors 21, 22 are coupled to each other, the inductance also changes therewith. Even if the width, intervals, etc. of lines constituting them were changed taking unnecessary reactance components into consideration, it is difficult to separately adjust the input impedance of the first and second input/output ports P1, P2, failing to find optimum conditions of matching with external circuits. Particularly the deviation of the input impedance of the first input/output port P1 is undesirable because it causes increase in the insertion loss.

OBJECTS OF THE INVENTION

Accordingly, the first object of the present invention is to provide a non-reciprocal circuit device having excellent electric characteristics such as insertion loss characteristics and isolation characteristics with a small microwave ferrite.

The second object of the present invention is to provide a non-reciprocal circuit device having excellent attenuation of harmonics.

The third object of the present invention is to provide a non-reciprocal circuit device whose input impedance can be easily adjusted.

DISCLOSURE OF THE INVENTION

As a result of intense research in view of the above objects, the inventors have found that when a third inductance element Lg constituting a parallel resonance circuit with a second capacitance element Cf is series-connected to a second inductance element L2, large voltage can be obtained between a connecting point PC and the ground, while suppressing the variation of the input impedance of first and second input/output ports P1, P2, thereby reducing the insertion loss. The present invention has been completed based on such finding.

Thus, the first non-reciprocal circuit device of the present invention comprises a first inductance element disposed between a first input/output port and a second input/output port; a second inductance element disposed between the second input/output port and the ground; a first capacitance element constituting a first parallel resonance circuit with the first inductance element; a resistance element parallel-connected to the first parallel resonance circuit; a third inductance element series-connected between the second inductance element and the ground; and a second capacitance element constituting a second parallel resonance circuit with the second and third inductance elements.

It is preferable that a first line constituting the first inductance element and a second line constituting the second inductance element are crossing, while a third line constituting the third inductance element is not crossing the first and second lines.

The first non-reciprocal circuit device preferably further comprises an impedance-adjusting means constituted by a fourth inductance element and/or a third capacitance element which is disposed between the first input/output port and the first parallel resonance circuit. The impedance-adjusting means is preferably a lowpass filter for attenuating harmonics.

The first inductance element preferably has inductance smaller than the total inductance of the second and third inductance elements.

The second non-reciprocal circuit device of the present invention comprises a first inductance element disposed between a first input/output port and a second input/output port; a second inductance element disposed between the second input/output port and the ground; a first capacitance element constituting a first parallel resonance circuit with the first inductance element; a resistance element parallel-connected to the first parallel resonance circuit; a third inductance element series-connected between the second inductance element and the ground; and a second capacitance element constituting a second parallel resonance circuit with the second and third inductance elements; the first and second inductance elements being constituted by first and second lines crossing with electric insulation on a main surface of or in a microwave ferrite; at least part of the first and/or second capacitance elements being constituted by electrode patterns formed on and/or in a laminate substrate; and the third inductance element being a core-less coil or a chip inductor mounted on the laminate substrate.

The first and second lines are preferably constituted by insulated copper wires, conductor wires printed on a ferrimagnetic body, or copper ribbons.

At least part of the first and/or second capacitance elements are preferably formed by electrode patterns on the laminate substrate. They may also be chip capacitors mounted on the laminate substrate.

The resistance element is preferably a chip resistor mounted on the laminate substrate or a printed resistor formed in the laminate substrate.

The second non-reciprocal circuit device preferably further comprises an impedance-adjusting means constituted by a fourth inductance element and/or a third capacitance element which is disposed between the first input/output port and the first parallel resonance circuit, the fourth inductance element and/or the third capacitance element being constituted by electrode patterns formed in the laminate substrate, or elements mounted on the laminate substrate.

The crossing angle of the first and second lines in the central conductors is preferably 80-110°.

In the non-reciprocal circuit device of the present invention, a resonance frequency providing the maximum isolation, which may be called "peak frequency," can be determined by adjusting the first inductance element and the first capacitance element, and a peak frequency providing the minimum insertion loss can be determined by adjusting the second and third inductance elements and the second capacitance element. Thus, the electric characteristics of the non-reciprocal circuit device can be determined by adjusting the first to third inductance elements and the first and second capacitance elements, depending on the frequency of a communications system employed by a communications equipment.

A rear-surface-side ground electrode for connecting the second capacitance element to the ground is preferably formed in the laminate substrate. Further, a main-surface-side ground electrode is preferably formed, such that an electrode pattern opposing the main-surface-side ground electrode and an electrode pattern opposing the rear-surface-side ground electrode are connected through via-holes to form the second capacitance element. Such structure prevents electromagnetic interference between electrode patterns formed in the laminate substrate and elements mounted on the main surface.

An electrode pattern forming the first capacitance element is preferably disposed between the electrode pattern opposing the main-surface-side ground electrode and the electrode pattern opposing the rear-surface-side ground electrode.

To reduce parasitic inductance, one end of the first line and one end of the second line are preferably opposing the main-surface-side ground electrode through via-holes, and connected to electrode patterns constituting the second capacitance element. A ground electrode having a smaller area than that of the rear-surface-side ground electrode is preferably disposed on a layer adjacent to the rear-surface-side ground electrode to adjust capacitance.

Terminal electrodes (input terminal, output terminal and ground terminals) are preferably formed on a rear surface of the laminate substrate along its periphery. The terminal electrodes are preferably formed with predetermined intervals from the periphery. Further, a connection-reinforcing terminal electrode is preferably formed in an inner region of the rear surface of the laminate substrate, the connection-reinforcing terminal electrode being connected to the rear-surface-side ground electrode through via-holes.

BRIEF DESCRIPTION OF THE DRAWINGS

FIG. 4(*b*) is a view showing the equivalent circuit of another example of impedance-adjusting means used in the non-reciprocal circuit device according to an embodiment of the present invention.

FIG. 4(*c*) is a view showing the equivalent circuit of a further example of impedance-adjusting means used in the non-reciprocal circuit device according to an embodiment of the present invention.

FIG. 4(*d*) is a view showing the equivalent circuit of a still further example of impedance-adjusting means used in the non-reciprocal circuit device according to an embodiment of the present invention.

FIG. 4(*e*) is a view showing the equivalent circuit of a still further example of impedance-adjusting means used in the non-reciprocal circuit device according to an embodiment of the present invention.

FIG. 5(*b*) is a view showing the equivalent circuit of a still further example of impedance-adjusting means used in the non-reciprocal circuit device according to an embodiment of the present invention.

FIG. 5(*c*) is a view showing the equivalent circuit of a still further example of impedance-adjusting means used in the non-reciprocal circuit device according to an embodiment of the present invention.

FIG. 5(*d*) is a view showing the equivalent circuit of a still further example of impedance-adjusting means used in the non-reciprocal circuit device according to an embodiment of the present invention.

FIG. 6(*b*) is a view showing the equivalent circuit of a still further example of impedance-adjusting means used in the non-reciprocal circuit device according to an embodiment of the present invention.

FIG. 6(*c*) is a view showing the equivalent circuit of a still further example of impedance-adjusting means used in the non-reciprocal circuit device according to an embodiment of the present invention.

FIG. 6(*d*) is a view showing the equivalent circuit of a still further example of impedance-adjusting means used in the non-reciprocal circuit device according to an embodiment of the present invention.

DESCRIPTION OF THE PREFERRED EMBODIMENTS

The non-reciprocal circuit device of the present invention will be explained below.

1 Non-reciprocal Circuit Device (1) Basic Operation

Figure 1:
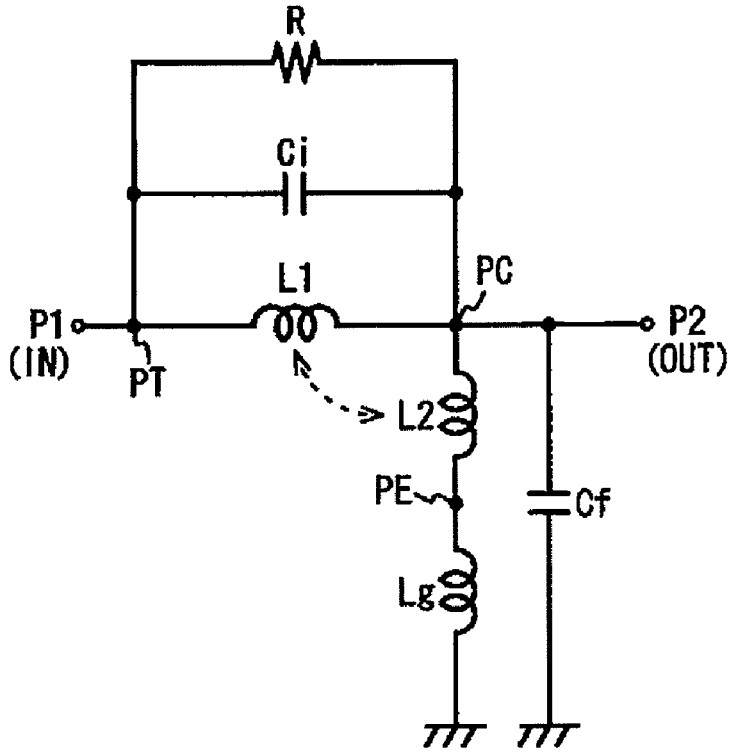
FIG. 1 is a view showing the equivalent circuit of a non-reciprocal circuit device according to an embodiment of the present invention.

FIG. 1 shows the equivalent circuit of the basic structure of the non-reciprocal circuit device according to an embodiment of the present invention. The non-reciprocal circuit device comprises a first inductance element L1 disposed between a first input/output port P1 and a second input/output port P2, a second inductance element L2 disposed between the second input/output port P2 and the ground, a first capacitance element Ci constituting a first parallel resonance circuit with the first inductance element L1, a resistance element R parallel-connected to the first parallel resonance circuit, a third inductance element Lg series-connected between the second inductance element L2 and the ground, and a second capacitance element Cf constituting a second parallel resonance circuit with the second inductance element L2 and the third inductance element Lg.

Figure 2:
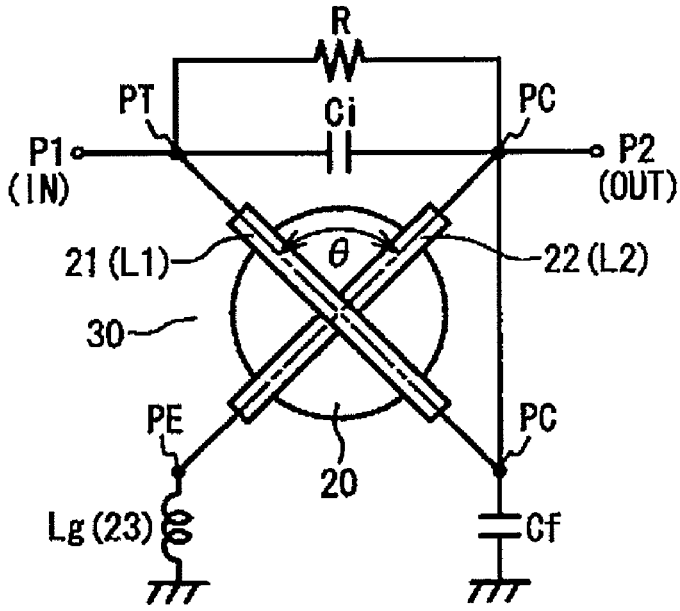
FIG. 2 is a view showing the equivalent circuit of a non-reciprocal circuit device according to an embodiment of the present invention.

FIG. 2 schematically shows the equivalent circuit of a central conductor 30 constituting the first inductance element L1 and the second inductance element L2, which are formed by first and second lines 21, 22 disposed on a ferrimagnetic microwave ferrite 20. The microwave ferrite 20 is usually a thin plate in a disc or rectangular shape.

The crux of the present invention is that the non-reciprocal circuit device comprises a third inductance element Lg series-connected to the second inductance element L2 to constitute a parallel resonance circuit with a second capacitance element Cf. The first line 21 constituting the first inductance element L1 and the second line 22 constituting the second inductance element L2 are crossing on the microwave ferrite 20. The third inductance element Lg is constituted by a third line 23 not coupled to the first line 21.

Microwaves entering the first input/output port P1 passes through the first line 21 (first inductance element), so that current flows through the second line 22 (second inductance element) and the third line 23 (third inductance element Lg) to excite the thin microwave ferrite plate 20. Because the thin microwave ferrite plate 20 is magnetized by a permanent magnet, high-frequency magnetic field components are generated by the ferromagnetic resonance effect of ferrite in a microwave band. Because a magnetic flux is generated in the microwave ferrite along the first line 21, voltage is not induced in the first line 21, but voltage is induced between both ends of the second line 22 because current flowing through the second line 22 crosses the magnetic flux. Accordingly, microwaves are transmitted between the first input/output port P1 and the second input/output port P2.

When microwaves are input to the second input/output port P2, current flows through the first and second lines 21, 22. With a magnetic flux generated in the microwave ferrite along the second line 22, voltage is induced not in the second line 22 but between both ends of the first line 21 because current flowing through the first line 21 crosses the magnetic flux. With voltage dropping at the first input/output port P1, microwaves are not substantially transmitted from the second input/output port to the first input/output port. Microwaves input to the second input/output port are consumed by the resistance element R parallel-connected to the first line 21.

Although the crossing angle θ between the first line and the second line can be arbitrarily set, it is preferably 70° to 120°, more preferably 80° to 110°, ideally 90°. The crossing angle θ is defined as a crossing angle of centerlines of the first and second lines in their end portions. Namely, it is an angle between the end portion of the first line on the first input/output port side and the end portion of the second line on the second input/output port side. The change of the crossing angle θ leads to the change of an optimum operating magnetic field from a permanent magnet, resulting in changing input impedance. In an ideal state free from any production variations, the input impedance is capacitive when the crossing angle θ is less than 90°, and inductive when the crossing angle θ is more than 90°. When the input impedance is capacitive, the impedance can be adjusted by using the ground connected to an inductance element. When the input impedance is inductive, the impedance can be adjusted by using a capacitance element.

To obtain excellent insertion loss characteristics and isolation characteristics, the first and second lines 21, 22 are preferably formed such that large voltage is induced at both ends of either one of them. To that end, it is necessary to use a large microwave ferrite, or to adjust the width, length and thickness of the first and second lines 21, 22, and the intervals of lines when pluralities of lines are used.

However, to miniaturize the non-reciprocal circuit device, the microwave ferrite should be made smaller, resulting in decrease not only in the effective permeability of the ferrimagnetic body but also in inductance obtained by the first and second lines 21, 22. This necessitates the use of large capacitance in the first and second parallel resonance circuits, failing to achieve excellent resonance characteristics. Also, because the first and second lines 21, 22 are coupled to each other, the adjustment of the width, etc. of one line affects their inductance. Accordingly, it is difficult to adjust the input impedance of the first and second input/output ports P1, P2 separately to achieve the optimum matching condition with an external circuit.

In view of this, the present invention adopts a structure in which the third inductance element Lg is series-connected to the second inductance element L2, and which the third line 23 forming the third inductance element Lg is not disposed on the ferrimagnetic body, thereby reducing capacitive or inductive coupling between the first inductance element L1 and the second inductance element L2. This enables large voltage to be generated between a connecting point PC and the ground, while reducing insertion loss by suppressing input impedance variations in the first and second input/output ports P1, P2.

Even if the second inductance element L2 has low inductance, the connection of the third inductance element Lg makes it unnecessary to provide the second capacitance element Cf with large capacitance. Thus, the second parallel resonance circuit has a large quality coefficient Q and excellent resonance characteristics, thereby preventing the deterioration of insertion loss characteristics by miniaturization. Further, because the first inductance element L1 disposed between the first input/output port P1 and the second input/output port P2 is constituted by a short line, loss increase can be prevented. Although the reduction of the inductance of the first inductance element L1 deteriorates isolation, its influence is smaller than the deterioration of insertion loss, causing no problems in practical applications.

(2) Impedance-adjusting Means

Figure 3:
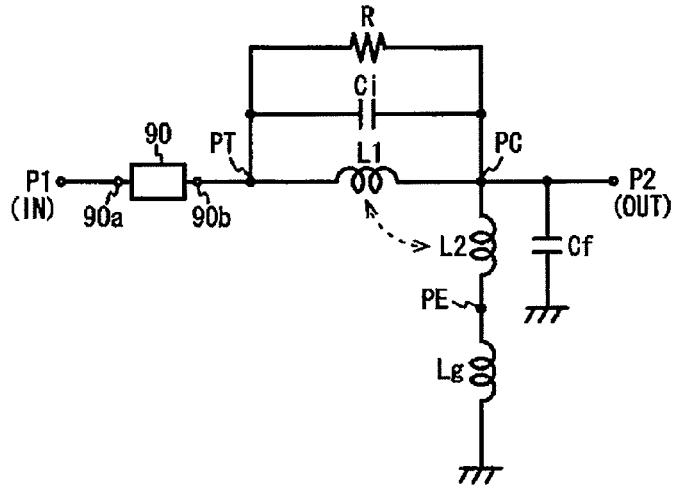
FIG. 3 is a view showing the equivalent circuit of a non-reciprocal circuit device according to another embodiment of the present invention.
Figure 4A:
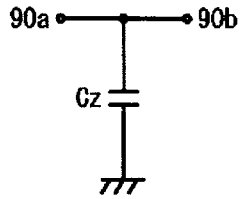
FIG. 4(*a*) is a view showing the equivalent circuit of one example of impedance-adjusting means used in the non-reciprocal circuit device according to an embodiment of the present invention.
Figure 4B:
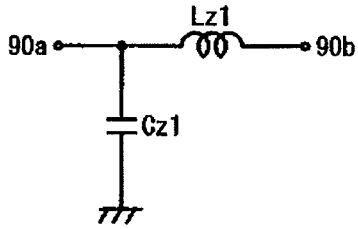
Figure 4C:
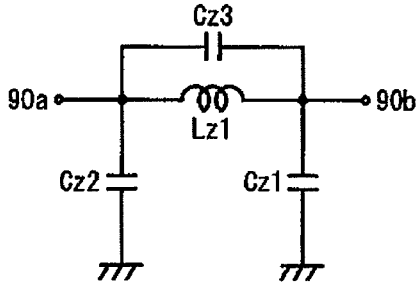
Figure 4D:
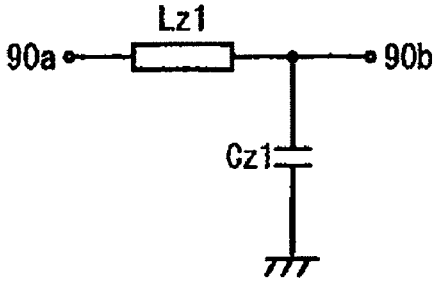
Figure 4E:
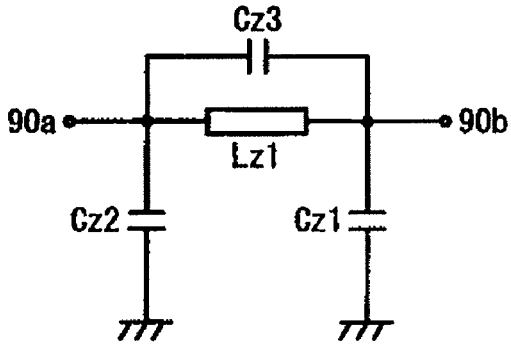
Figure 5A:
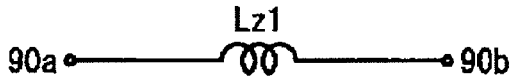
FIG. 5(*a*) is a view showing the equivalent circuit of a still further example of impedance-adjusting means used in the non-reciprocal circuit device according to an embodiment of the present invention.
Figure 5B:
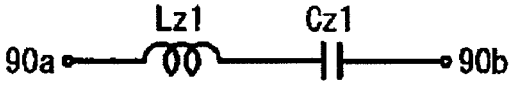
Figure 5C:
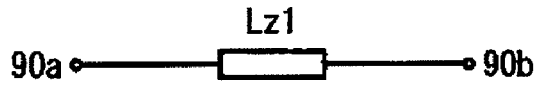
Figure 5D:
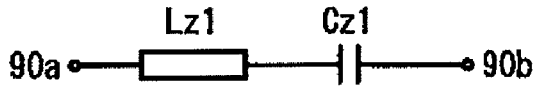
Figure 6A:
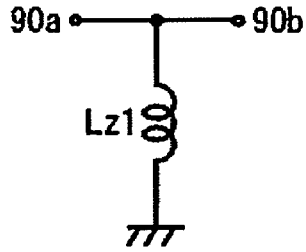
FIG. 6(*a*) is a view showing the equivalent circuit of a still further example of impedance-adjusting means used in the non-reciprocal circuit device according to an embodiment of the present invention.
Figure 6B:
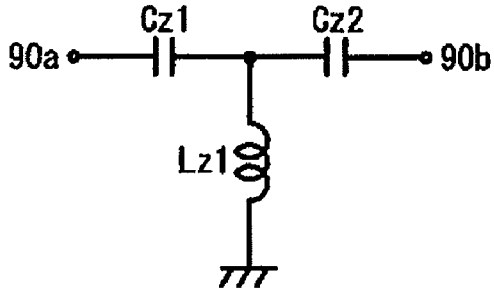
Figure 6C:
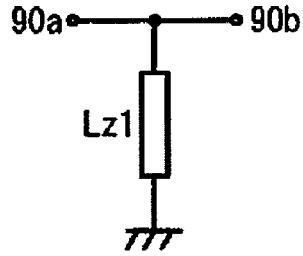
Figure 6D:
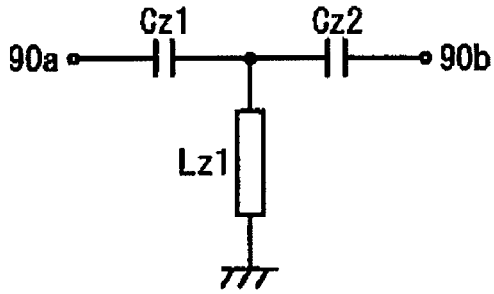

As shown in the equivalent circuit of FIG. 3, an impedance-adjusting means 90 is preferably disposed between the first input/output port P1 and a port PT. The impedance-adjusting means 90 is constituted by a fourth inductance element and/or a third capacitance element. The input impedance of the connecting point PT may be inductive or capacitive depending on production variations such as parasitic inductance, floating capacitance, etc. Such reactance variations lower insertion loss and isolation due to mismatching with an external circuit. The desired impedance matching is thus achieved by using an impedance-adjusting means 90 having capacitive input impedance when the input impedance (viewed from the connecting point PT) of the non-reciprocal circuit device is inductive, or by using an impedance-adjusting means 90 having inductive input impedance when the above input impedance is capacitive.

The impedance-adjusting means 90 shown in FIGS. 4-6 are constituted by proper combinations of inductance elements and capacitance elements depending on the input impedance. Depending on the combination of inductance elements and capacitance elements, a highpass filter circuit, a lowpass filter circuit or a notch filter circuit is obtained.

Though not particularly restricted, the inductance elements and the capacitance elements constituting the impedance-adjusting means 90 are preferably constituted by chip devices because of easy handling and relatively easy changing of constants. They may be formed by electrode patterns in a multi-layer substrate. In the non-reciprocal circuit device of the present invention, the impedance-adjusting means may be one or more inductance elements or a combination of one or more inductance elements with one or more capacitance elements. The inductance element may be a chip inductor, or an electrode pattern (line pattern) of a conductive paste printed on a dielectric sheet.

When inductance elements and capacitance elements used for the impedance-adjusting means are formed by electrode patterns in the laminate substrate, their adjustment is difficult without trimming. However, when chip capacitors and chip inductors are used, capacitance and inductance can be finely set to provide good impedance matching.

The non-reciprocal circuit device exhibits similar transmission characteristics to those of a bandpass filter, but when it does not have sufficient off-band attenuation, the impedance-adjusting means 90 need only be constituted by a lowpass filter or a notch filter. Unnecessary frequency components (harmonics) such as second harmonics and third harmonics supplied from a power amplifier can be removed.

(3) Power Amplifier

In a power amplifier connected to the non-reciprocal circuit device, a harmonics-controlling circuit such as an open stub, a short-circuited stub, etc. is connected to the output terminal (drain electrode) of a high-frequency power transistor. This harmonics-controlling circuit is open in a basic frequency, and short-circuited for harmonics (for instance, second harmonics) having frequencies even times the basic frequency. With such structure, harmonics generated in the amplifier are cancelled by waves reflecting from the connecting point of the harmonics-controlling circuit, thereby achieving a high-efficiency operation.

There is a case where the input impedance of the non-reciprocal circuit device is substantially short-circuited for second harmonics. Under such impedance condition, the operation of the power amplifier is unstable, causing oscillation, etc. Thus, utilizing the impedance-adjusting means 90 as a phase circuit to cause phase shift, non-conjugated matching is achieved between the power amplifier and the non-reciprocal circuit device, thereby suppressing the oscillation of the power amplifier. For instance, when the inductance element in the impedance-adjusting means 90 is a line series-connected between the first input/output port P1 and the port PT, its input impedance can be adjusted to a range desired for second harmonics by changing line length and shape.

To cause a large phase shift, the line need only be lengthened, but it may deteriorate the electric characteristics. When the phase θ cannot sufficiently be adjusted only with the impedance-adjusting means 90, it can be adjusted by a third inductance element Lg between a port PE and the ground potential. As in a case where the impedance-adjusting means 90 has a long transmission line, the third inductance element Lg having large inductance can shift the phase clockwise.

2 First Embodiment

Figure 7:
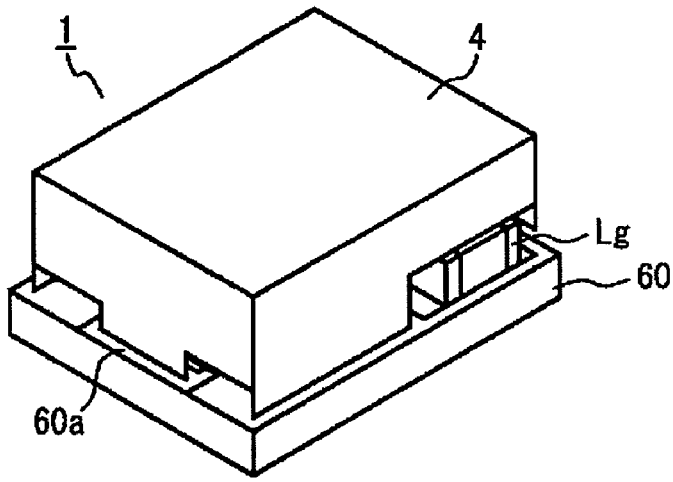
FIG. 7 is a perspective view showing a non-reciprocal circuit device according to an embodiment of the present invention.
Figure 8:
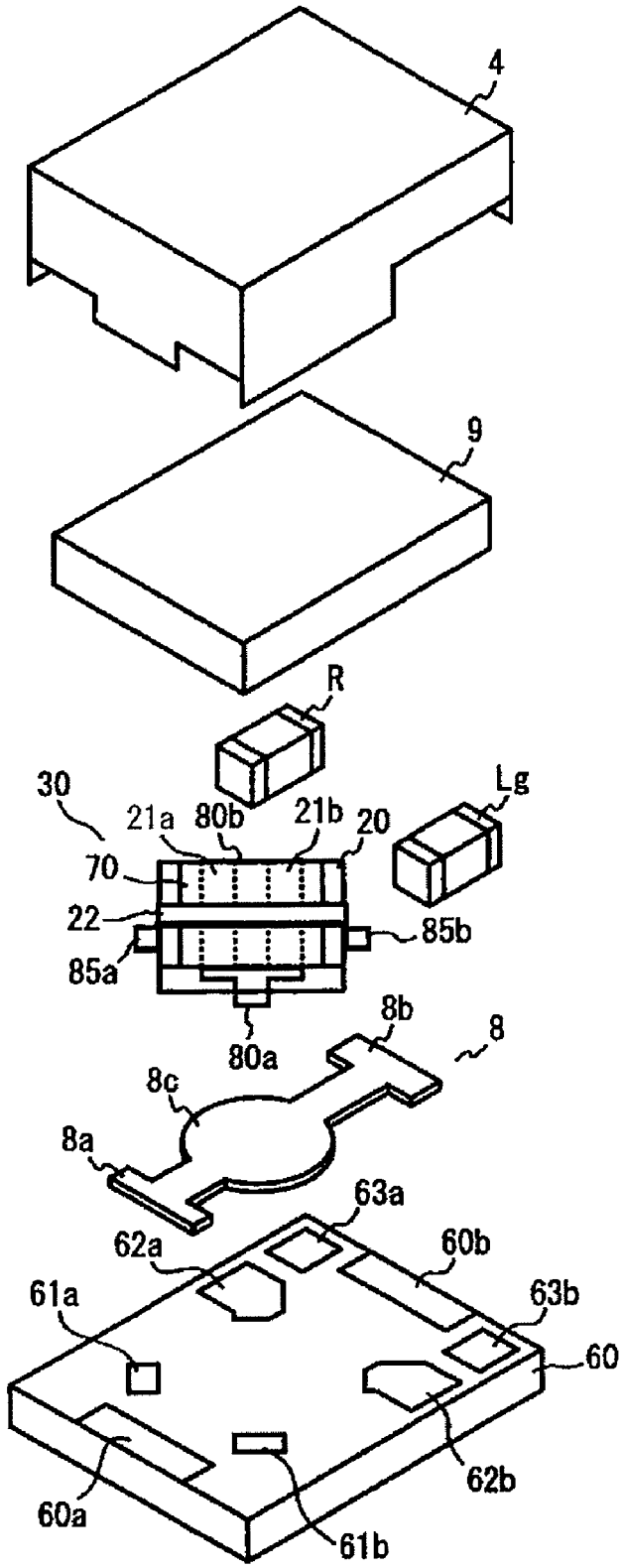
FIG. 8 is an exploded perspective view showing the non-reciprocal circuit device according to an embodiment of the present invention.

FIG. 7 shows the appearance of a non-reciprocal circuit device 1, and FIG. 8 shows its structure. The non-reciprocal circuit device 1 comprises a central conductor assembly 30 comprising a microwave ferrite 20 and first and second lines 21, 22 crossing thereon with electric insulation; a laminate substrate 60 comprising a first capacitance element Ci and a second capacitance element Cf each constituting a resonance circuit with the first line 21 and the second line 22; chip devices (resistance element R and a third inductance element Lg) mounted on the laminate substrate 60; upper and lower yokes 4, 8 constituting a magnetic circuit; and a permanent magnet 9 applying a DC magnetic field to the microwave ferrite 20. Because the equivalent circuit of this non-reciprocal circuit device is the same as shown in FIGS. 1 and 2, its explanation will be omitted.

In the central conductor assembly 30, the first and second lines 21, 22 are crossing on a microwave ferrite 20 (for instance, rectangular) via an insulating layer (not shown). In this embodiment, the first and second lines 21, 22 are crossing perpendicularly (at a crossing angle θ of 90°), though not restrictive.

The first line 21 is constituted by two conductor lines 21*a*, 21*b*, and the second line 22 is constituted by one conductor line. In this embodiment, the first and second lines 21, 22 are formed by thin copper plates and insulated from each other with polyimide. The line is preferably formed by a copper plate, for instance, a thin plate having a thickness of 10-40 μm. The line is preferably provided with semi-gloss silver plating having a thickness of 1-4 μm. Such structure can reduce loss by a skin effect at high frequencies.

The first and second lines 21, 22 can be produced, for instance, by a method comprising (1) printing a conductive paste of Ag, Cu, etc. on a green sheet to form electrode patterns constituting the first and second lines 21, 22 by (a) a method of forming electrode patterns by printing or etching on both surfaces of a flexible, heat-resistant, insulating sheet of polyimide, etc., (b) a method of forming electrode patterns on a microwave ferrite 10 by direct printing as described in JP 2004-88743 A, or (c) an LTCC (low-temperature co-fired ceramics) method, (2) laminating the green sheet having the above electrode patterns with a green sheet constituting the microwave ferrite 10, and (3) integrally sintering the resultant laminate.

Although the microwave ferrite 20 is rectangular in this embodiment, it is not restrictive but may be disc-shaped. It should be noted, however, that the rectangular microwave ferrite 20 is more advantageous than the disc-shaped microwave ferrite 20 in that the former enables the use of longer first and second lines 21, 22 having larger inductance.

The microwave ferrite 20 need only be made of a magnetic material enabling a function as a non-reciprocal circuit device to a DC magnetic field from a permanent magnet 9. The microwave ferrite 20 preferably has a garnet structure, being made of YIG (yttrium-iron garnet), etc. In YIG, part of Y may be substituted by Cd, Ca, V, etc., and part of Fe may be substituted by Al, Ga, etc. It may be Ni ferrite depending on a frequency used.

The permanent magnet 9 applying a DC magnetic field to the central conductor assembly 30 is fixed to an inner wall of a substantially box-shaped, upper case 4 with an adhesive, etc. The permanent magnet 9 is preferably an inexpensive ferrite magnet ($SrO\text{-}nFe_2O_3$) having temperature characteristics adapted for the microwave ferrite 20. Particularly preferable is ferrite magnet having a magnetoplumbite-type crystal structure in which part of Sr and/or Ba is substituted by an R element (at least one of rare earth elements including Y), and part of Fe is substituted by an M element (at least one selected from the group consisting of Co, Mn, Ni and Zn), the R element and/or the M element being added as compounds at a pulverization step after calcination, because it has a higher magnetic flux density than that of usual ferrite magnet ($SrO\text{-}nFe_2O_3$), enabling the non-reciprocal circuit device to be smaller and thinner. The ferrite magnet preferably has a residual magnetic flux density Br of 420 mT or more, and coercivity iHc of 300 kA/m or more. Rare earth magnets such as Sm—Co magnet, Sm—Fe—N magnet, Nd—Fe—B magnet, etc. may also be used.

Figure 9:
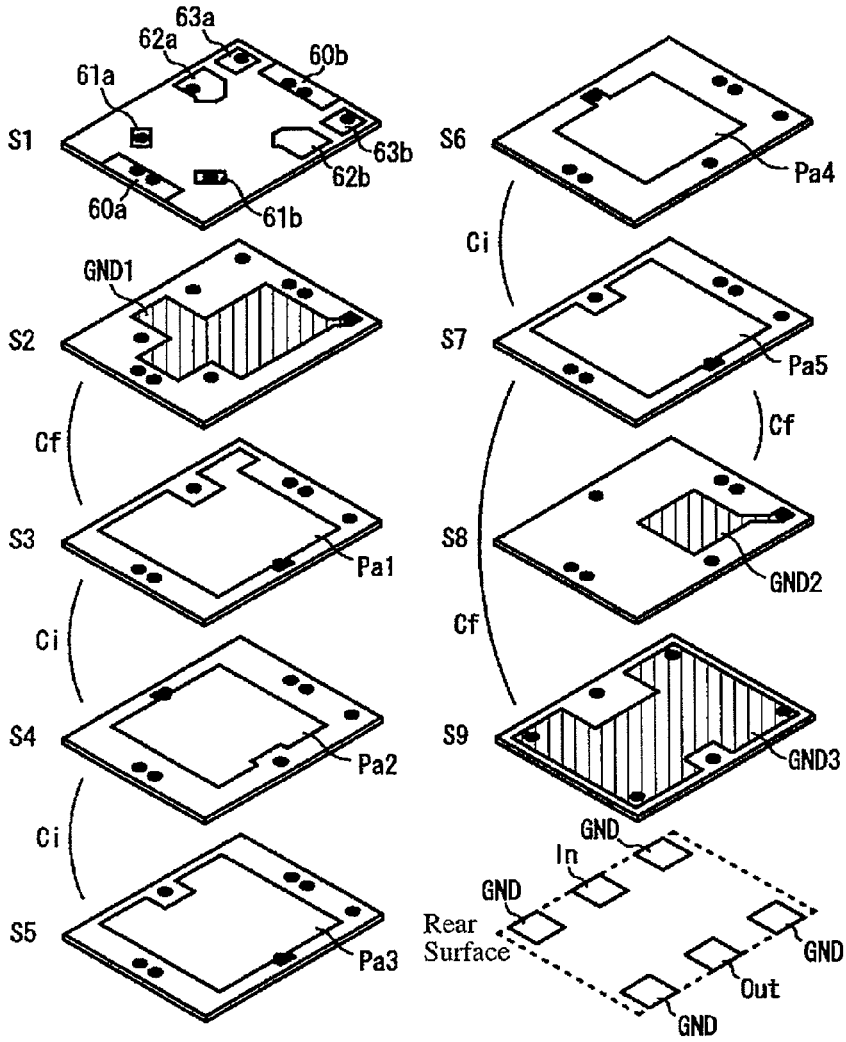
FIG. 9 is an exploded perspective view showing a laminate substrate used in the non-reciprocal circuit device according to an embodiment of the present invention.

FIG. 9 shows the structure of the laminate substrate 60. The laminate substrate 60 is constituted by integrally laminating nine dielectric sheets S1-S9. Each dielectric sheet S1-S9 is printed with a conductive paste to form electrode patterns. A dielectric sheet S1 is provided with electrode patterns 60*a*, 60*b*, 61*a*, 61*b*, 62*a*, 62*b*, 63*a*, 63*b* functioning as lands for mounting parts. A dielectric sheet S2 is provided with an electrode pattern GND1. A dielectric sheet S3 is provided with an electrode pattern Pa1, a dielectric sheet S4 is provided with an electrode pattern Pa2, a dielectric sheet S5 is provided with an electrode pattern Pa3, a dielectric sheet S6 is provided with an electrode pattern Pa4, a dielectric sheet S7 is provided with an electrode pattern Pa5, a dielectric sheet S8 is provided with an electrode pattern GND2, and a dielectric sheet S9 is provided with an electrode pattern GND3.

Electrode patterns on the dielectric sheets S1-S9 are electrically connected through via-holes (shown by black circles in the figure) filled with a conductive paste. As a result, the electrode patterns Pa1, Pa2, Pa3, Pa4, Pa5 constitute the first capacitance element Ci, and the electrode patterns GND1, Pa1, Pa5, GND2, GND3 constitute the second capacitance element Cf.

In this embodiment, the first and second capacitance elements Ci, Cf are laminated capacitors constituted by electrode patterns formed on pluralities of layers and parallel-connected through via-holes. The desired capacitance is obtained without flat area increase by forming one large electrode pattern on each layer of the laminate substrate 60, and laminating an electrode pattern for the first capacitance element Ci and an electrode pattern for the second capacitance element Cf.

Ceramics for the dielectric sheets S1-S9 are preferably low-temperature co-firable ceramics (LTCC) that can be simultaneously sintered with a conductive paste of Ag, etc. From the environmental aspect, lead-free, low-temperature co-firable ceramics are preferable. The low-temperature co-firable ceramics preferably have a composition comprising 100% by mass of main components comprising 10-60% by mass (as $Al_2O_3$) of Al, 25-60% by mass (as $SiO_2$) of Si, 7.5-50% by mass (as SrO) of Sr, and more than 0% by mass and 20% or less by mass (as $TiO_2$) of Ti, and a sub-component which is at least one selected from the group consisting of 0.1-10% by mass (as $Bi_2O_3$) of Bi, 0.1-5% by mass (as $Na_2O$) of Na, 0.1-5% by mass (as $K_2O$) of K, 0.1-5% by mass (as CoO) of Co, 0.01-5% by mass (as CuO) of Cu, 0.01-5% by mass (as $MnO_2$) of Mn, and 0.01-5% by mass of Ag. When the laminate substrate 50 is made of low-temperature co-firable ceramics having a high Q value, high-conductivity metals such as Ag, Cu, Au, etc. can be used for the electrode patterns, thereby providing a non-reciprocal circuit device having extremely low loss.

A ceramic mixture having the above composition is calcined at 700-850° C., pulverized to an average particle size of 0.6-2 μm, mixed with a binder such as ethylcellulose, a thermoplastic olefinic elastomer and polyvinyl butyral (PVB), a plasticizer such as butylphthalyl butylglycolate (BPBG), and a solvent to form slurry, and formed into dielectric green sheets by a doctor blade method, etc. Each green sheet is provided with via-holes, and printed with a conductive paste to form an electrode pattern and fill via-holes with the conductive paste. Thus obtained are dielectric sheets S1-S9 shown in FIG. 9, which are laminated, and sintered at 850-1050° C. to form a laminate substrate 60.

Electrode patterns on a surface of the multi-layer substrate 60 are preferably provided with Ni plating and Au plating in this order. The Au plating having high electric conductivity and good solder wettability can lower the loss of the non-reciprocal circuit device. The Ni plating improves bonding strength between the electrode pattern of Ag, Cu, Ag—Pd, etc. and the Au plating. The thickness of the electrode pattern including the plating is usually about 5-20 m, preferably two times or more the thickness providing the skin effect.

Because laminate substrate 60 is about 2.5 mm×2.5 mm×0.3 mm or smaller, it is preferable to produce a mother laminate substrate comprising pluralities of laminate substrates 60 connected via dividing grooves, and breaking it along the dividing grooves to separate individual laminate substrates 60. Of course, a mother laminate substrate without dividing grooves may be cut by a dicer or a laser.

To obtain a laminate substrate 60 with small sintering strain by suppressing the sintering shrinkage of the laminate substrate in a plane direction (X-Y direction), it is preferable to use a constraint sintering method comprising the steps of sintering the laminate sandwiched by shrinkage-suppressing sheets that are not sintered at a sintering temperature (particularly 1000° C. or lower), and removing the shrinkage-suppressing sheets from the laminate substrate 60. Sintering is preferably conducted while pressing in a Z direction. Materials for the shrinkage-suppressing sheet may be alumina powder, a mixture of alumina powder and stabilized zirconia powder, etc. The shrinkage-suppressing sheets are removed after sintering, by an ultrasonic cleaning method, a wet-honing method, a blasting method, etc.

The upper and lower yokes 4, 8 will be explained below. The upper yoke 4 is substantially box-shaped, made of a ferromagnetic material such as soft iron, etc. to form a magnetic circuit, and plated with Ag or Cu. The lower yoke 8 is the same as the upper yoke 4 in a material, etc., and comprises substantially I-shaped end portions 8*a*, 8*b*, and a region 8*c* having a relatively large area for mounting the central conductor assembly 30 substantially in a center portion. With the lower yoke 8 received in the upper yoke 4, a magnetic path enclosing the permanent magnet 9 and the central conductor assembly 30 is formed.

The upper and lower yokes 4, 8 are preferably covered with a high-conductivity metal layer made of at least one selected from the group consisting of Ag, Cu, Au and Al or its alloy, and having electric resistivity of 5.5 μΩcm or less, preferably 3.0 μΩcm, more preferably 1.8 μΩcm or less, which is formed by plating, etc. The thickness of the metal layer is 0.5-25 μm, preferably 0.5-10 μm, more preferably 1-8 μm. Such structure can suppress interference with the ambient environment (for instance, the intrusion of electromagnetic noises into the yoke), thereby reducing the loss.

Figure 10:
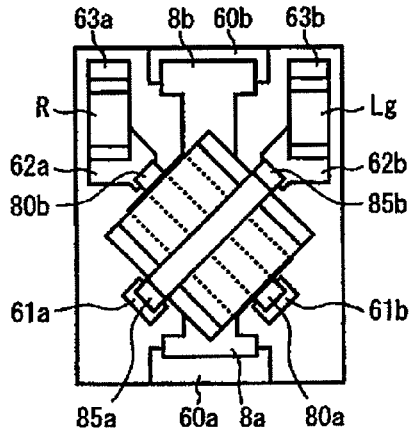
FIG. 10 is an exploded plan view showing the non-reciprocal circuit device according to an embodiment of the present invention.

FIG. 10 is a plan view showing a main surface of the non-reciprocal circuit device, from which the upper yoke 4 and the permanent magnet 9 are omitted. A chip resistor R is soldered between electrode patterns 62*a*, 63*a*, and a chip inductor Lg constituting the third inductance element is soldered between electrode patterns 62*b*, 63*b*. The central conductor assembly 30 is disposed in the mounting region 8*c* of the lower yoke 8. The first line 21 has an end portion 80*a* soldered to the electrode pattern 61*b*, and an end portion 80*b* soldered to the electrode pattern 62*a*. The second line 22 has an end portion 85*a* soldered to the electrode pattern 61*a*, and an end portion 85*b* soldered to the electrode pattern 62*b*. End portions of the lower yoke 8 are soldered to the electrode patterns 60*a*, 60*b*. After the laminate substrate 60 is covered with the upper yoke 4 to which the permanent magnet 40 is bonded, lower edges of sidewalls of the upper yoke 70 are soldered to the electrode patterns 60*a*, 60*b*. When a necessary operating magnetic field is applied from the permanent magnet 9, the central conductor assembly 30 may be directly mounted on the laminate substrate 60 without the lower yoke 8. This reduces the height of the non-reciprocal circuit device by the thickness of the lower yoke 8.

The input terminal IN (P1) and the output terminal OUT (P2) are disposed on a rear peripheral edge of the laminate substrate 60, such that the ground terminal GND is enclosed by them. The terminals IN (P1), OUT (P2) are constituted by electrode patterns in an LGA (land grid array), and connected to electrode patterns in the laminate substrate 60, central conductors, mounted devices, etc. through via-holes.

3 Second Embodiment

Figure 11:
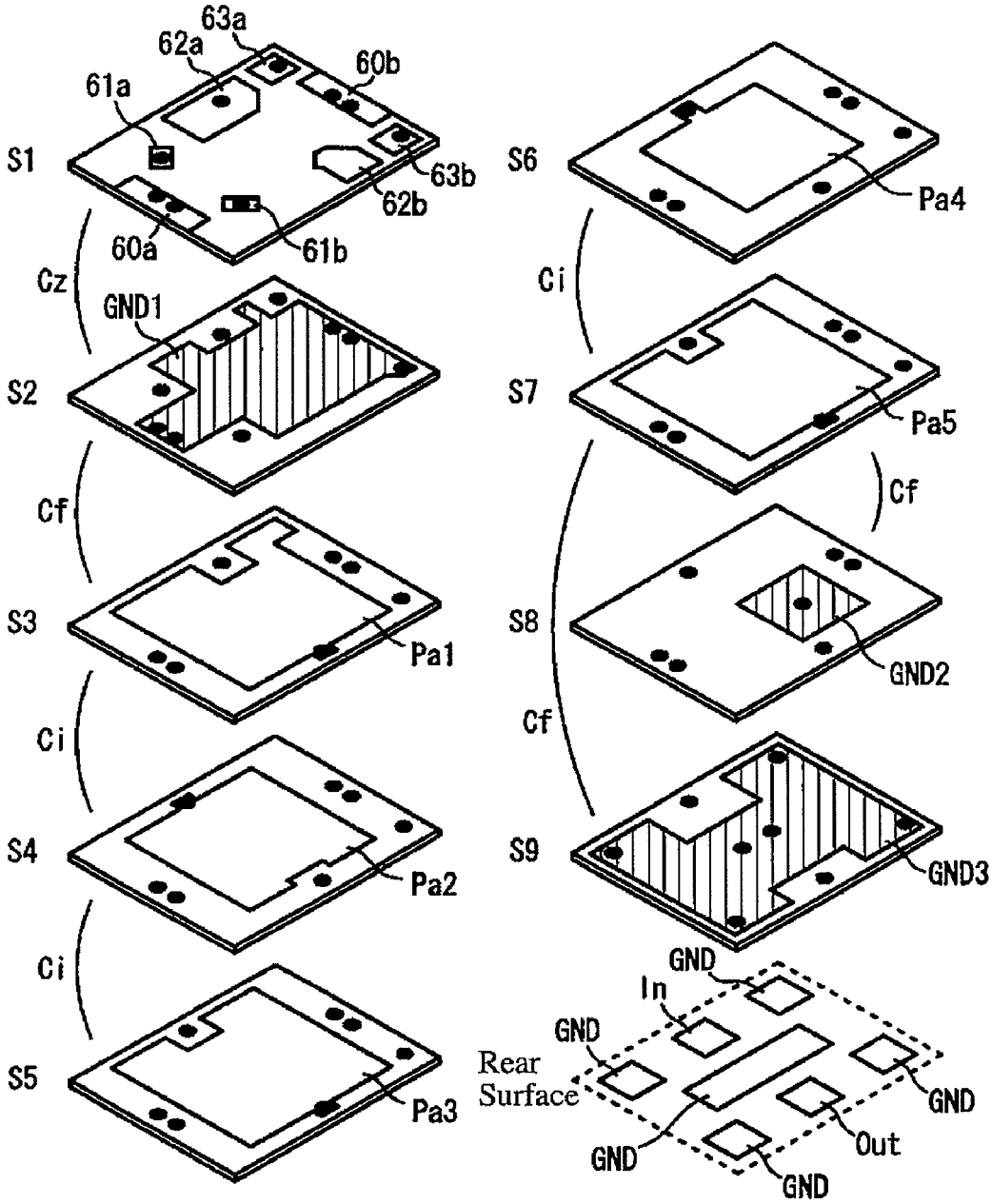
FIG. 11 is an exploded perspective view showing a laminate substrate used in the non-reciprocal circuit device according to another embodiment of the present invention.

FIG. 3 shows the equivalent circuit of the non-reciprocal circuit device according to the second embodiment of the present invention, and FIG. 11 shows the structure of a laminate substrate 60 used in this embodiment. This embodiment is the same as the first embodiment in many portions, whose explanation will be omitted. Accordingly, the explanation of the first embodiment is applicable to this embodiment unless otherwise mentioned.

In this embodiment, an impedance-adjusting means 90 is disposed between the first input/output port and the first parallel resonance circuit. The impedance-adjusting means 90 used is the capacitance element Cz (grounded capacitor) shown in FIG. 4(*a*). Because the capacitance element Cz is constituted by electrode patterns 62*a* and GND1 in the laminate substrate 60, impedance matching can be achieved without increasing the number of parts mounted.

The capacitance element Cz may be constituted by a chip capacitor mounted between electrode patterns 62*a*, 60*b* on the laminate substrate 60. In this case, the adjustment of input impedance can be easily conducted by selecting the chip capacitor. Also, the mounted chip capacitor and a capacitance element in the laminate substrate may be combined. Thus, the capacitance of the impedance-adjusting means in the laminate substrate 50 can be adjusted by the chip capacitor.

On a rear surface of the laminate substrate 60, an input terminal IN (P1) and an output terminal OUT (P2) sandwiching the ground terminal GND are disposed along a peripheral edge with a predetermined interval therefrom. Such structure prevents terminal patterns from peeling, when the mother laminate substrate is divided, or when stress is applied after mounted on a circuit board. Also, a connection-reinforcing terminal electrode is disposed in an inside region of a rear surface of the laminate substrate, to increase bonding strength to the circuit board. Further, the connection-reinforcing terminal electrode is connected to the rear-surface-side ground electrode through via-holes, to improve the peeling resistance of the connection-reinforcing terminal electrode, and to stabilize the ground.

The present invention will be explained in more detail referring to Examples below without intention of restricting the scope of the present invention.

Example 1

A ceramic mixture having a composition comprising 100% by mass of main components comprising 50% by mass (as $Al_2O_3$) of Al, 36% by mass (as $SiO_2$) of Si, 10% by mass (as SrO) of Sr, and 4% by mass (as $TiO_2$) of Ti, and sub-components comprising 2.5% by mass (as $Bi_2O_3$) of Bi, 2.0% by mass (as $Na_2O$) of Na, 0.5% by mass (as $K_2O$) of K, and 0.3% by mass (as CuO) of Cu was calcined at 800° C., pulverized to an average particle size of 1.2 μm, mixed with a polyvinyl butyral (PVB) binder, a butylphthalyl butylglycolate (BPBG) plasticizer, and water to form slurry, and formed into 30-μm-thick dielectric green sheets by a doctor blade method. Each green sheet was provided with via-holes, and printed with a conductive Ag paste comprising 75% by mass of Ag powder having an average particle size of 2 μm and 25% by mass of ethylcellulose to form an electrode pattern and fill the via-holes. Thereafter, green sheets were laminated and sintered to produce a laminate substrate 60.

Using the above laminate substrate 60, an ultra-small non-reciprocal circuit device of 2.5 mm×2.0 mm×1.2 mm for a frequency of 830-840 MHz (CDMA) shown in FIGS. 1, 2 and 7-10 was produced. Main parts in this non-reciprocal circuit device were a microwave ferrite 20 (garnet of 1.0 mm×1.0 mm×0.15 mm), a permanent magnet (rectangular La—Co ferrite magnet of 2.0 mm×1.5 mm×0.25 mm), and a laminate substrate 60 of 2.5 mm×2.0 mm×0.3 mm. The first and second lines 21, 22 were formed by plating 15-μm-thick copper on both surfaces of a 20-μm-thick, heat-resistant, insulating polyimide sheet, and etching the resultant copper layer. Each line 21, 22 was provided with semi-gloss Ag plating having a thickness of 1-4 μm. The circuit constant, etc. of the non-reciprocal circuit device of Example 1 are shown in Table 1.

TABLE 1

| Elements | Example 1 |
|---|---|
| First capacitance element Ci | 32 pF (Capacitor*) |
| Second capacitance element Cf | 22 pF (Capacitor*) |
| First inductance element L1 | 1.1 nH |
| (First line) | Line width: 0.18 mm each |
| | Line interval: 0.18 mm |
| Second inductance element L2 | 1.7 nH |
| (Second line) | Line width: 0.20 mm each |
| Third inductance element Lg | 1.2 nH (0603-size chip inductor) |
| (Third line) | |
| Resistor R | 60 Ω (0603-size chip resistor) |

Note:
A capacitor formed in the laminate substrate.

Comparative Example 1

Figure 19:
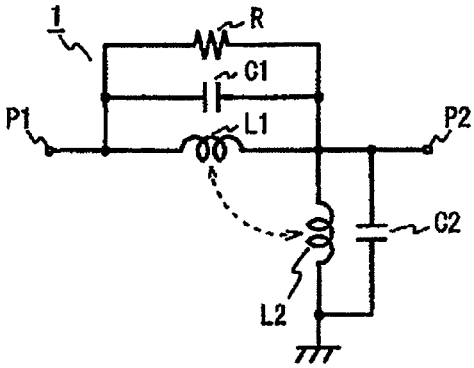
Fig. 19 PRIOR ART
FIG. 19 is a view showing the equivalent circuit of a conventional non-reciprocal circuit device (two-terminal isolator).
Figure 20:
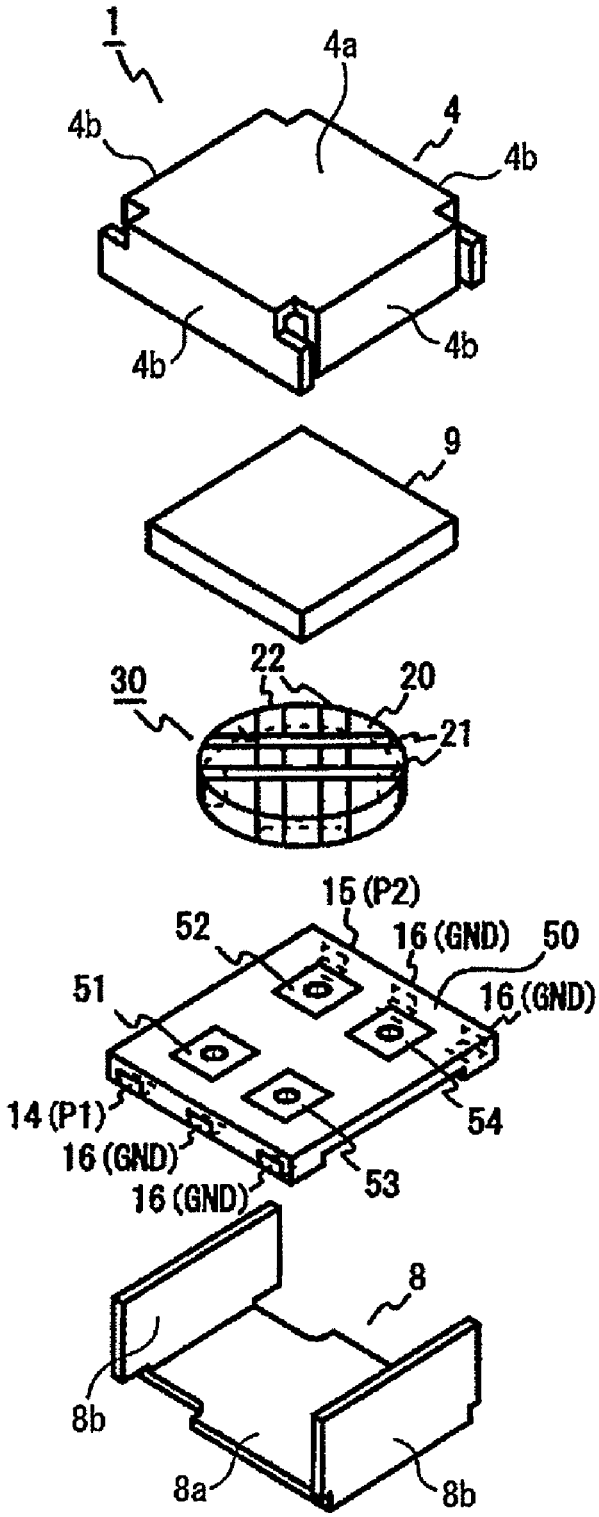
Fig. 20 PRIOR ART
FIG. 20 is an exploded perspective view showing a conventional non-reciprocal circuit device.
Figure 21:
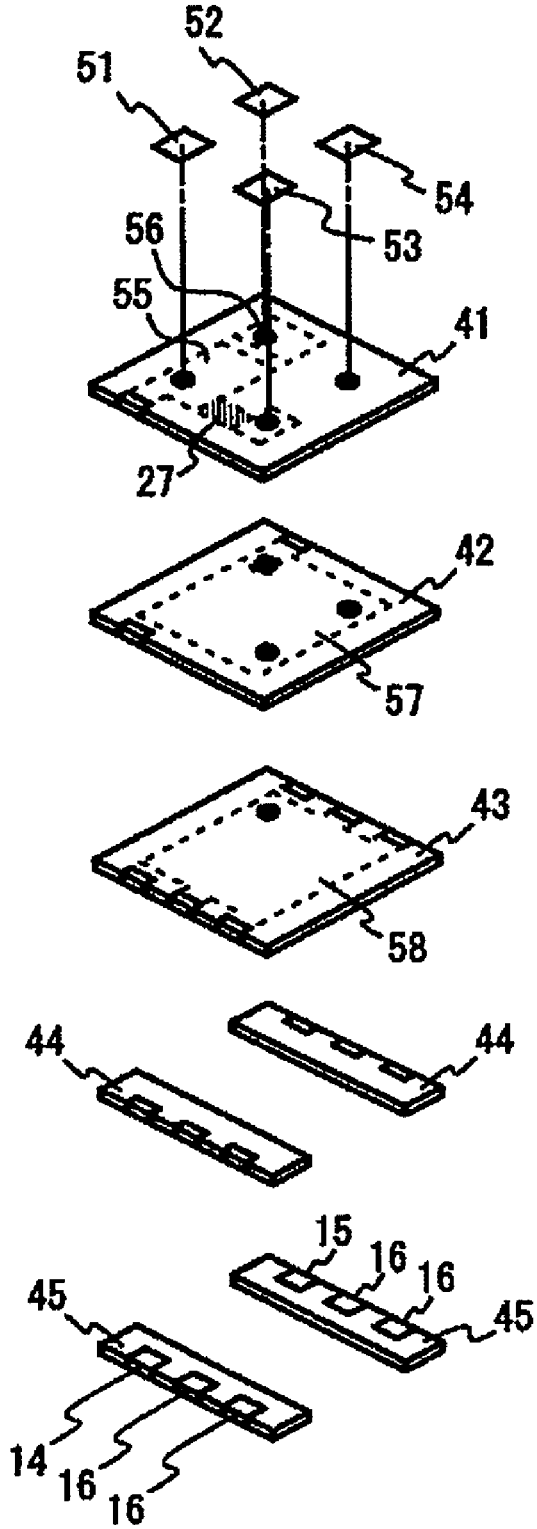
Fig. 21 PRIOR ART
FIG. 21 is an exploded perspective view showing a laminate substrate used in the conventional non-reciprocal circuit device.
Figure 22:
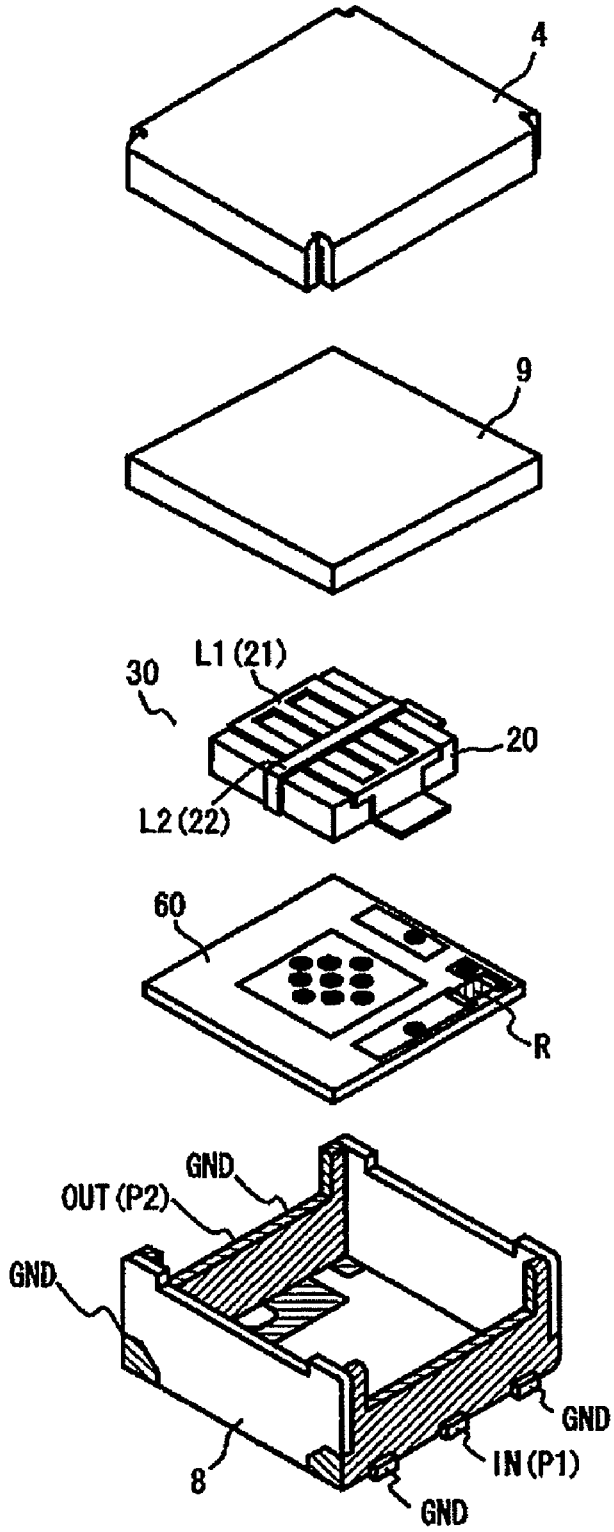
Fig. 22 PRIOR ART
FIG. 22 is an exploded perspective view showing a conventional non-reciprocal circuit device.

The non-reciprocal circuit device of Comparative Example 1 having an equivalent circuit shown in FIG. 19 and a structure shown in FIG. 22 was produced. The first and second capacitance elements Ci, Cf of this non-reciprocal circuit device were constituted by electrode patterns (not shown) formed in a laminate substrate 60. A heat-resistant resin (hatched portion) such as liquid crystal Palomar is injection-molded integrally with a lower yoke 8, and provided with an input terminal IN (P1) and an output terminal OUT (P2), etc. on side surfaces to produce a case, in which a laminate substrate 60, a central conductor assembly 30, etc. were placed. Because extremely poorer characteristics would be obtained if its size were the same as in Example, a non-reciprocal circuit device of 3.2 mm×3.2 mm×1.6 mm was produced in this Comparative Example. Main parts used in this non-reciprocal circuit device were a microwave ferrite 10 (garnet of 1.9 mm×1.9 mm×0.35 mm), and a permanent magnet (rectangular, permanent La—Co ferrite magnet of 2.8 mm×2.5 mm×0.4 mm). The first and second lines 21, 22 were formed by etching a 30-μm-thick copper plate, and provided with semi-gloss Ag plating having a thickness of 1-4 μm. The circuit constant, etc. of the non-reciprocal circuit device of Comparative Example 1 are shown in Table 2.

TABLE 2

| Elements | Comparative Example 1 |
|---|---|
| First capacitance element Ci | 32 pF (Capacitor*) |
| Second capacitance element Cf | 19 pF (Capacitor*) |
| First inductance element L1 | 1.1 nH |
| (First line) | Line width: 0.18 mm each |
| | Line intervals: 0.18 mm each |
| Second inductance element L2 | 1.9 nH |
| (Second line) | Line width: 0.20 mm each |
| Resistor R | 75 Ω (Printed resistor) |

Note:
A capacitor formed in the laminate substrate.

The off-band attenuation, insertion loss and isolation of the non-reciprocal circuit devices of Example 1 and Comparative Example 1 were measured by a network analyzer.

Figure 12:
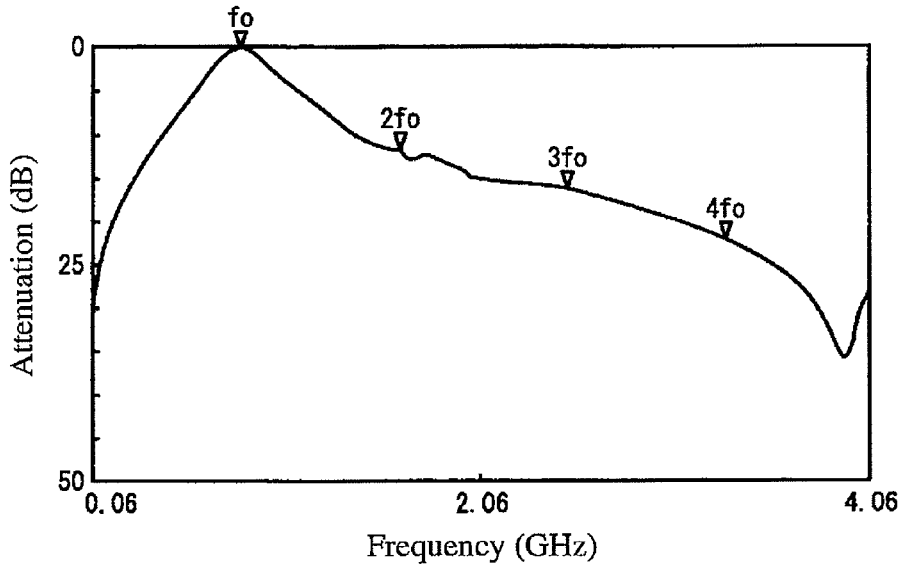
FIG. 12 is a graph showing the frequency characteristics of the off-band attenuation of the non-reciprocal circuit device of Example 1.
Figure 13:
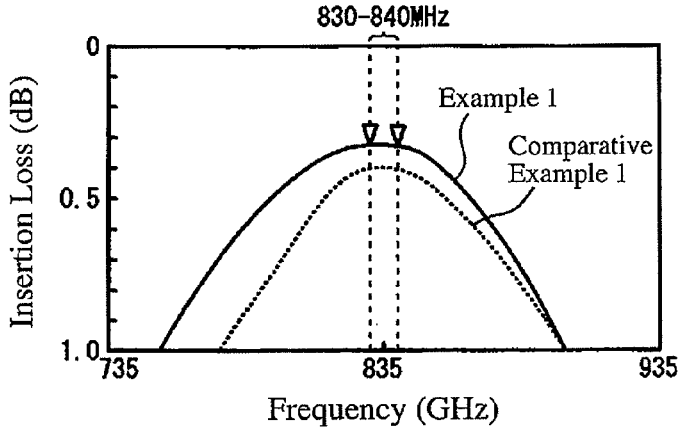
FIG. 13 is a graph showing the frequency characteristics of the insertion loss of the non-reciprocal circuit devices of Example 1 and Comparative Example 1.
Figure 14:
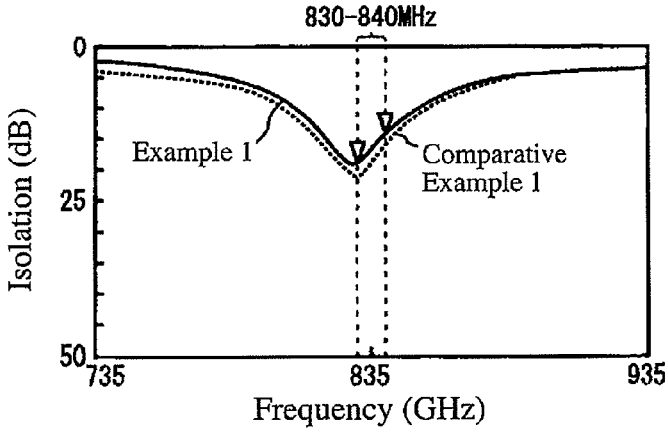
FIG. 14 is a graph showing the frequency characteristics of the isolation of the non-reciprocal circuit devices of Example 1 and Comparative Example 1.

FIG. 12 is a graph showing the off-band attenuation, FIG. 13 is a graph showing the insertion loss, and FIG. 14 is a graph showing the isolation. In FIG. 12, "fo" is a center frequency in a passband, and nfo, wherein n is 2-4, etc. are n-times frequencies. It was found that the non-reciprocal circuit device of Example 1 was substantially on the same level as that of Comparative Example 1 in the off-band attenuation and isolation, but the former had improved insertion loss and excellent high-frequency characteristics.

Example 2

A non-reciprocal circuit device was produced in the same manner as in Example 1, except that the capacitance element Cz (grounded capacitor) shown in FIG. 4(*a*) was disposed as an impedance-adjusting means 90, and that the laminate substrate 60 shown in FIG. 11 according to the second embodiment of the present invention was produced. The equivalent circuit of the laminate substrate 60 is shown in FIG. 3. The capacitance element Cz was constituted by an electrode pattern 62*a* and GND 1 in a laminate substrate 60, and disposed between the first input/output port and the first parallel resonance circuit.

The measurement of off-band attenuation, insertion loss and isolation by a network analyzer revealed that this non-reciprocal circuit device had the same isolation characteristics as those of conventional non-reciprocal circuit devices, with improved insertion loss characteristics and excellent high-frequency characteristics.

Examples 3 and 4

The laminate substrates 60 of Examples 3 and 4 were produced in the same manner as in Example 2, except that an impedance-adjusting means 90 was constituted by a capacitance element Cz and an inductance element Lz1. The impedance-adjusting means 90 was disposed between the first input/output port and the first parallel resonance circuit.

Figure 15:
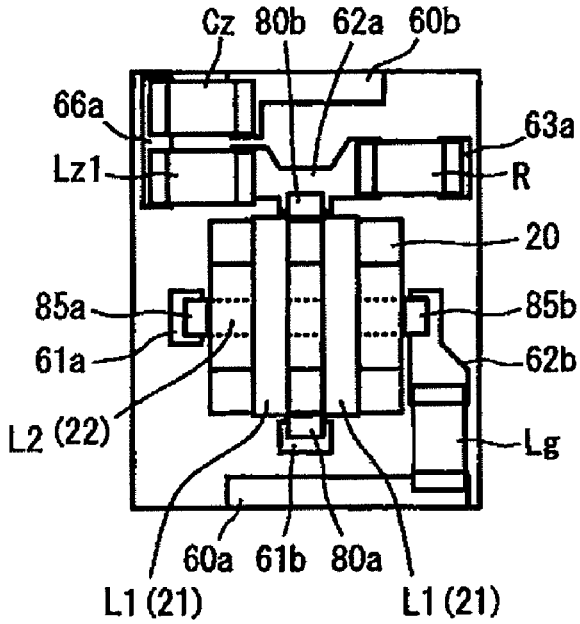
FIG. 15 is an exploded plan view showing a non-reciprocal circuit device according to another embodiment of the present invention.

Example 3 used the circuit shown in FIG. 4(*b*) as the impedance-adjusting means 90. As shown by the exploded plan view of FIG. 15, the capacitance element Cz as a chip capacitor of 2 pF and the inductance element Lz1 as a chip inductance of 10 nH were mounted on the laminate substrate 60. The input terminal IN (P1) of the laminate substrate 60 was connected to an electrode pattern 66*a* in the laminate substrate through via-holes, and then connected to central conductors, etc. through the inductance element Lz1. The electrode pattern 66*a* was further connected to an electrode pattern 60*b* and the ground through a capacitance element Cz to constitute a lowpass filter.

Figure 16:
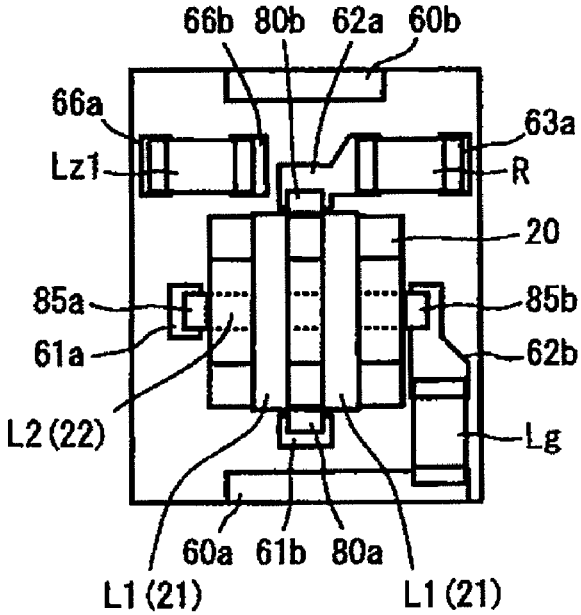
FIG. 16 is an exploded plan view showing a non-reciprocal circuit device according to a further embodiment of the present invention.

Example 4 used the circuit shown in FIG. 5(*b*) as the impedance-adjusting means 90. As shown by the exploded plan view of FIG. 16, the capacitance element Cz of 2 pF was constituted by an electrode pattern in the laminate substrate 60, and the inductance element Lz1 as a chip inductance of 10 nH was mounted on the laminate substrate 60. The input terminal IN (P1) of the laminate substrate 60 was connected to the electrode pattern 66*a* on the laminate substrate through via-holes, and connected to the electrode pattern 66*b* through the inductance element Lz1. The electrode pattern 66*b* was connected to an electrode pattern (not shown) in the laminate substrate through via-holes, to form the capacitance element Cz with the electrode pattern 62*a*. In Examples 3 and 4, a lower yoke 8 was not disposed, but a central conductor assembly 30 was mounted directly on the laminate substrate 60.

Figure 17:
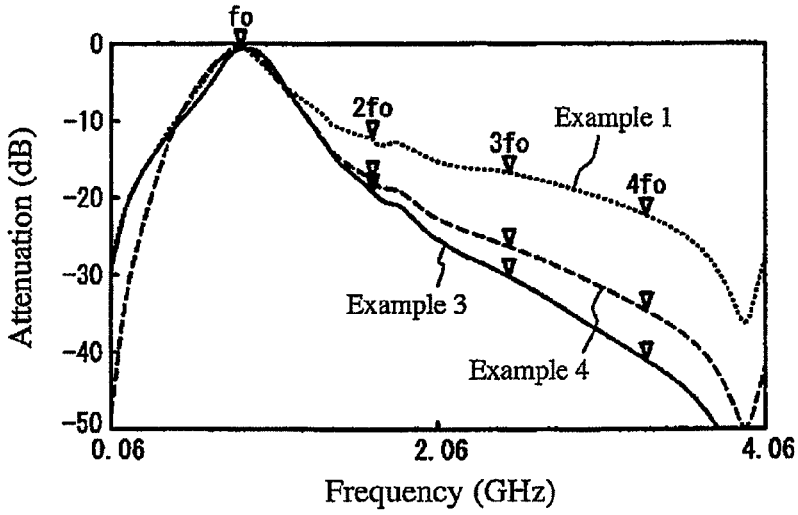
FIG. 17 is a graph showing the frequency characteristics of the off-band attenuation of the non-reciprocal circuit devices of Examples 1, 3 and 4.
Figure 18:
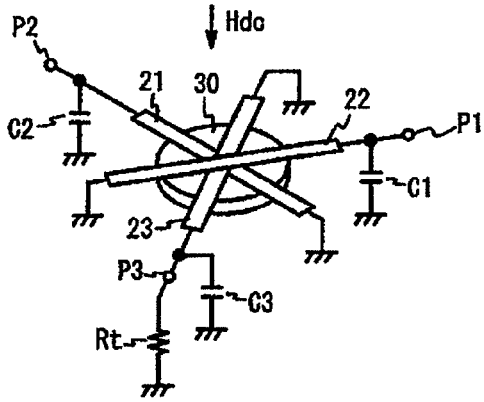
Fig. 18 PRIOR ART
FIG. 18 is a view showing the equivalent circuit of a conventional non-reciprocal circuit device.

The measurement of off-band attenuation, insertion loss and isolation by a network analyzer revealed that the non-reciprocal circuit devices of Examples 3 and 4 were on the same level as that of Example 1 in the isolation. With respect to the insertion loss, both non-reciprocal circuit devices suffered decrease of about 0.03 dB because the inductance element Lz1 was series-connected to a signal line, but the non-reciprocal circuit devices of Examples 3 and 4 were better than conventional ones. FIG. 17 shows the frequency characteristics of the off-band attenuation. The non-reciprocal circuit devices of Examples 3 and 4 had better high-frequency characteristics of the off-band attenuation than those of Example 1.

EFFECT OF THE INVENTION

The present invention provides a non-reciprocal circuit device having excellent electric characteristics such as insertion loss characteristics and isolation characteristics, as well as excellent harmonics attenuation and easy-to-adjust input impedance despite its small size.

The present invention provides a non-reciprocal circuit device (two-terminal isolator) having low insertion loss and excellent isolation despite its small size. It also provides a non-reciprocal circuit device having easy-to-adjust input impedance without deteriorating insertion loss characteristics and reflection characteristics. Accordingly, when disposed between a power amplifier and an antenna in a transmission system in a mobile communications equipment, it can transmit signals with low loss, while preventing unnecessary signals from flowing into the power amplifier. It also stabilizes the impedance of the power amplifier on the load side, thereby expanding battery life in cell phones, etc.

What is claimed is:

1. A non-reciprocal circuit device comprising a first inductance element disposed between a first input/output port and a second input/output port, a second inductance element disposed between the second input/output port and ground, a first capacitance element constituting a first parallel resonance circuit with said first inductance element, a resistance element parallel-connected to said first parallel resonance circuit, a third inductance element series-connected between said second inductance element and ground, and a second capacitance element constituting a second parallel resonance circuit with said second and third inductance elements.

2. The non-reciprocal circuit device according to claim 1, wherein a first line constituting said first inductance element and a second line constituting said second inductance element are crossing, while a third line constituting said third inductance element is not crossing said first and second lines.

3. The non-reciprocal circuit device according to claim 1, wherein said first inductance element has inductance which is smaller than the total inductance of said second inductance element and said third inductance element.

4. The non-reciprocal circuit device according to claim 1, which comprises an impedance-adjusting means constituted by a fourth inductance element and/or a third capacitance element which is disposed between the first input/output port and said first parallel resonance circuit.

5. The non-reciprocal circuit device according to claim 4, wherein said impedance-adjusting means is a lowpass filter.

6. A non-reciprocal circuit device comprising a first inductance element disposed between a first input/output port and a second input/output port; a second inductance element disposed between the second input/output port and ground; a first capacitance element constituting a first parallel resonance circuit with said first inductance element; a resistance element parallel-connected to said first parallel resonance circuit; a third inductance element series-connected between said second inductance element and ground; and a second capacitance element constituting a second parallel resonance circuit with said second inductance element and said third inductance element; said first and second inductance elements being constituted by first and second lines crossing with electric insulation on a main surface of or in a microwave ferrite; at least part of said first and/or second capacitance elements being constituted by electrode patterns formed on and/or in a laminate substrate; and said third inductance element being a core-less coil or a chip inductor mounted on said laminate substrate.

7. The non-reciprocal circuit device according to claim 6, wherein said resistance element is a chip resistor mounted on said laminate substrate or a printed resistor formed in said laminate substrate.

8. The non-reciprocal circuit device according to claim 6, which further comprises an impedance-adjusting means constituted by a fourth inductance element and/or a third capacitance element which is disposed between the first input/output port and said first parallel resonance circuit, and wherein said fourth inductance element and/or said third capacitance element are constituted by electrode patterns formed in said laminate substrate, or elements mounted on said laminate substrate.

* * * * *